US006510584B2

(12) United States Patent
Vystrcil et al.

(10) Patent No.: US 6,510,584 B2
(45) Date of Patent: Jan. 28, 2003

(54) FLOW CUT-OFF AND BRUSHROLL SHUT-OFF MECHANISM FOR VACUUM CLEANER

(75) Inventors: Robert A. Vystrcil, Garrettsville, OH (US); Charles J. Thur, Chardon, OH (US); Steven J. Paliobeis, Painesville, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/759,409

(22) Filed: Jan. 12, 2001

(65) Prior Publication Data

US 2002/0092120 A1 Jul. 18, 2002

(51) Int. Cl.[7] ..... A47L 5/32
(52) U.S. Cl. ..... 15/332; 15/334
(58) Field of Search ..... 15/331, 332, 334, 15/337

(56) References Cited

U.S. PATENT DOCUMENTS 2,072,690 A * 3/1937 Smellie ..... 15/314
4,811,452 A * 3/1989 Sumerau ..... 15/333
5,042,109 A 8/1991 Stephens
5,247,720 A 9/1993 Sovis et al.
5,331,715 A * 7/1994 Johnson et al. ..... 15/323
5,477,586 A * 12/1995 Jacobs et al. ..... 15/332
5,732,439 A * 3/1998 Cipolla ..... 15/334
6,209,168 B1 * 4/2001 Brickner et al. ..... 15/332

* cited by examiner

*Primary Examiner*—Chris K. Moore
(74) *Attorney, Agent, or Firm*—Fay, Sharpe, Fagan, Minnich & McKee, LLP

(57) ABSTRACT

A vacuum cleaner includes a floor nozzle having a brushroll chamber with an outlet aperture. An upper assembly is secured to the floor nozzle and is adapted to pivot relative to the floor nozzle about a generally horizontal pivot axis. A dirt cup is removably secured to the upper assembly. The dirt cup includes a dirt collection chamber, a forward inlet duct, and a rear inlet duct spaced from the first inlet duct. A flow cut-off mechanism selectively blocks the outlet aperture. The flow cut-off mechanism includes a dirt passage in communication with the outlet aperture and a dirt passage door that pivots forward about an approximately upright axis within the dirt passage cavity to block the outlet aperture when the upper assembly is moved to a fully upright position. The brushroll shut-off mechanism includes a micro-switch assembly which electrically controls operation of the brushroll motor.

21 Claims, 8 Drawing Sheets

FLOW CUT-OFF AND BRUSHROLL SHUT-OFF MECHANISM FOR VACUUM CLEANER

BACKGROUND OF THE INVENTION

This invention relates to vacuum cleaners. More particularly, it relates to a flow cut-off and brushroll shut-off mechanism for a vacuum cleaner that is convertible for on-the-floor and above-the-floor vacuuming operations.

One way of increasing the amount of suction power available at a distal end of a suction airflow pathway (such as at a floor nozzle, or at an above-the-floor cleaning tool) for a given source of suction power is to reduce the length of the suction airflow pathway.

In the case of vacuum cleaners having a single source of suction power and multiple (e.g. two) suction airflow pathways (such as vacuum cleaners that are convertible between on-the-floor and above-the-floor cleaning operations), a further way of increasing the amount of suction power available at the distal end of an airflow pathway being used (e.g. from an above-the-floor cleaning tool) is to shut-off the suction airflow through the unused pathway (e.g. from the floor nozzle).

It is known to pivot a dirt passage door around a horizontal axis extending generally lateral across a vacuum cleaner floor nozzle to shut-off suction airflow through a floor nozzle airflow passage. However, such a pivoting arrangement limits the ability to reduce the length of the suction airflow pathway.

Accordingly, it is considered desirable to develop a new and improved vacuum cleaner having a flow cut-off mechanism and brushroll shut-off mechanism that meets the above-stated needs and overcomes the foregoing difficulties and others while providing better and more advantageous results.

BRIEF SUMMARY OF THE INVENTION

One aspect of the present invention relates to a floor nozzle for a vacuum cleaner.

More particularly in accordance with this aspect of the invention, the floor nozzle includes a brushroll chamber having an outlet aperture; and a flow cut-off mechanism that selectively blocks the outlet aperture, the flow cut-off mechanism includes a dirt passage in communication with the outlet aperture and a dirt passage door that pivots about an approximately upright axis within the dirt passage to block the outlet aperture.

In accordance with another aspect of the invention, a vacuum cleaner is provided. More particularly, in accordance with this aspect of the invention, the vacuum cleaner includes a floor nozzle; and an upper assembly secured to the floor nozzle and adapted to pivot relative to the floor nozzle about a generally horizontal pivot axis; the floor nozzle including a brushroll chamber having an outlet aperture, and a flow cut-off mechanism that selectively blocks the outlet aperture, the flow cut-off mechanism includes a dirt passage in communication with the outlet aperture and a dirt passage door that pivots about an approximately upright axis within the dirt passage to block the outlet aperture.

More particularly in accordance with this aspect of the invention, the vacuum cleaner includes a floor nozzle including a brushroll chamber having an outlet aperture; an upper assembly secured to the floor nozzle and adapted to pivot relative to the floor nozzle about a generally horizontal pivot axis; a dirt cup removably secured to the upper assembly, the dirt cup including a dirt collection chamber, a forward inlet duct, and a rear inlet duct spaced from the first inlet duct; and a flow cut-off mechanism that selectively blocks the outlet aperture, the flow cut-off mechanism including a dirt passage in communication with the outlet aperture and a dirt passage door that pivots forward about an approximately upright axis within the dirt passage to block the outlet aperture when the upper assembly is moved to a fully upright position.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENTS

Figure 1:
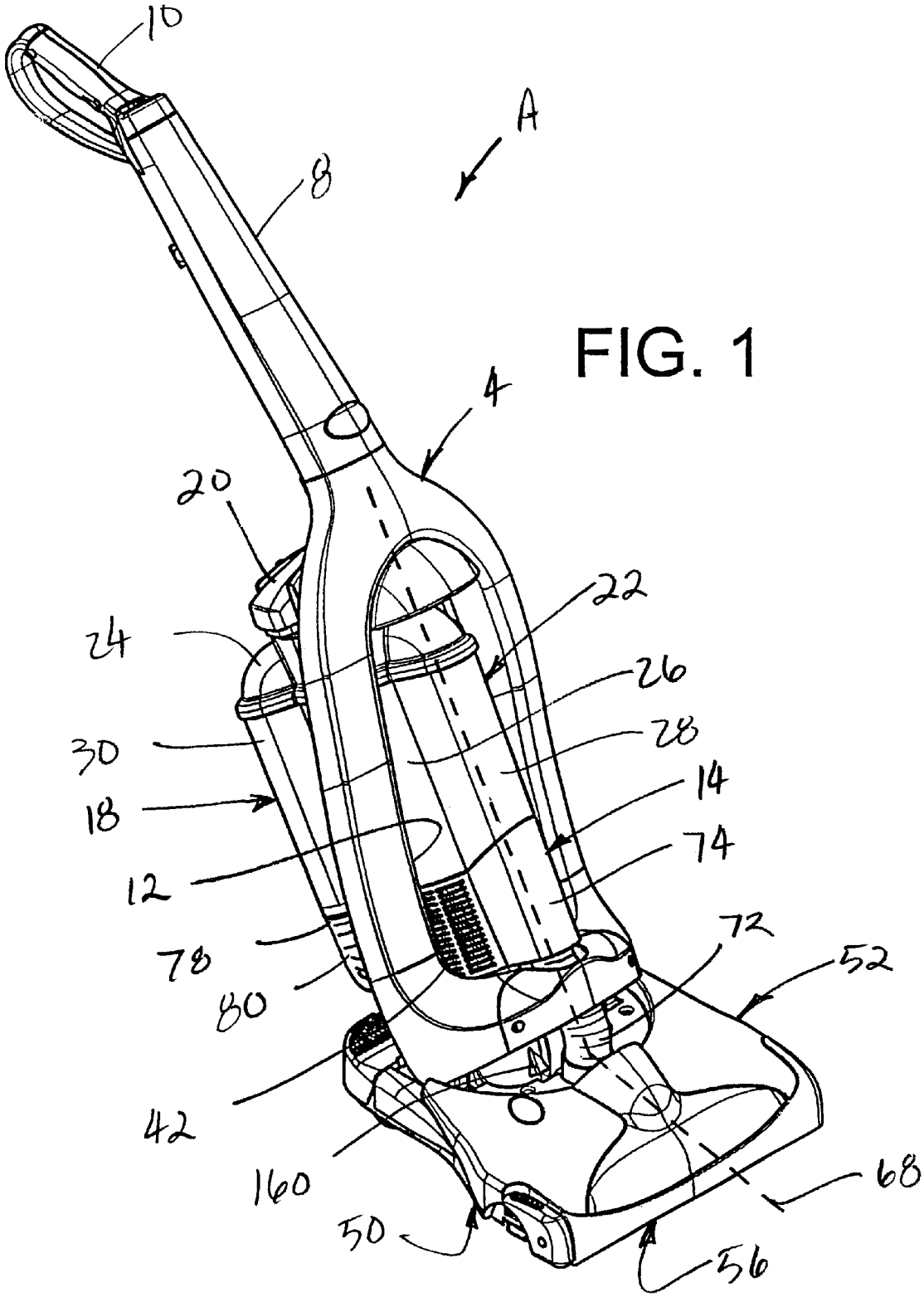
FIG. 1 is a perspective view from the left front of a vacuum cleaner according to the present invention.

Referring now to the drawings, wherein the showings are for purposes of illustrating a preferred embodiment of the invention only and not for purposes of limiting same, there is shown a particular type of upright vacuum cleaner in which the subject flow cut-off mechanism is embodied. While the flow cut-off mechanism can be employed in this type of vacuum cleaner, it should be appreciated that it can be used in other types of vacuum cleaners as well.

Figure 2:
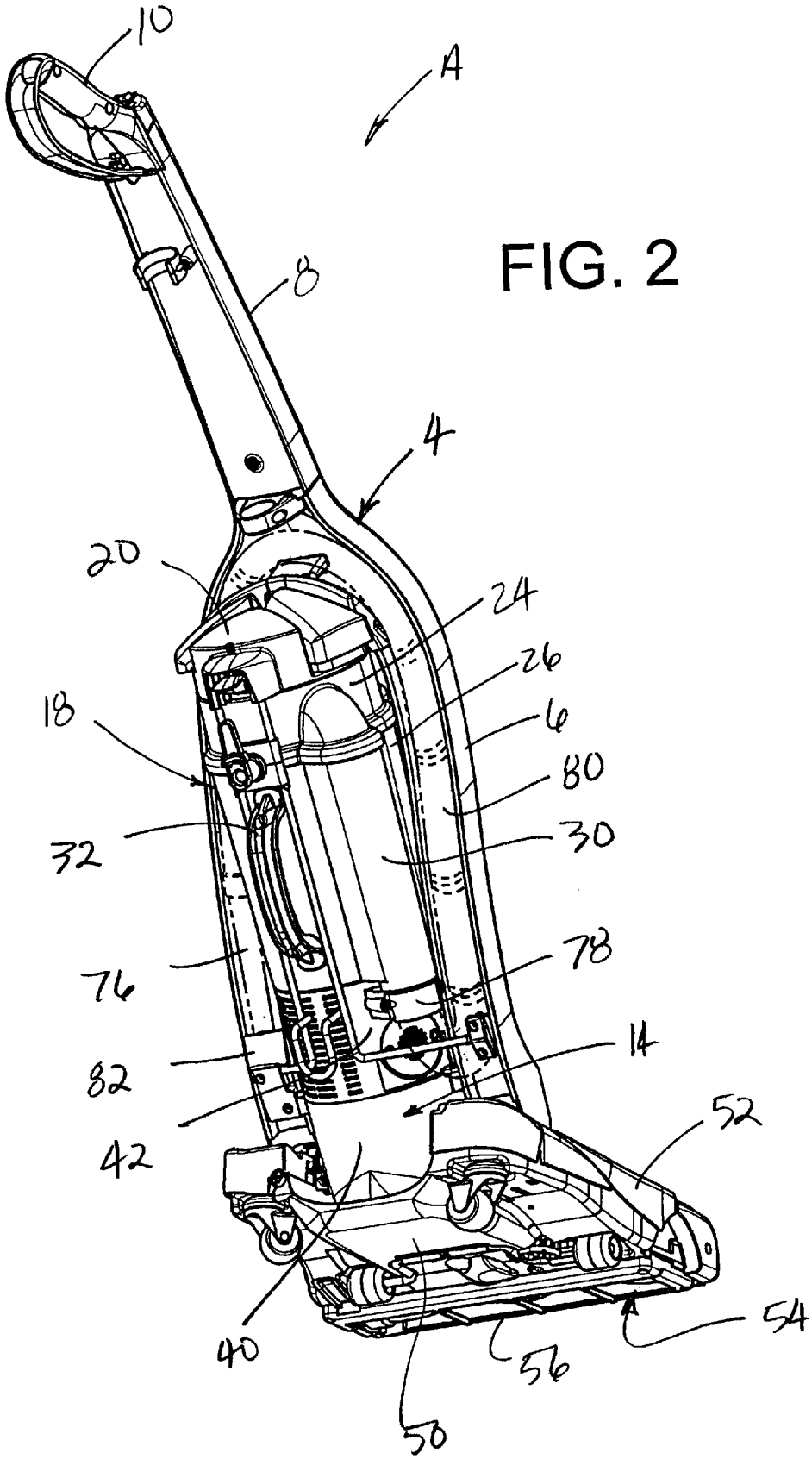
FIG. 2 is a perspective view from the left rear of the vacuum cleaner of FIG. 1.

More particularly, FIGS. 1 and 2 illustrate an upright vacuum cleaner A including a wheeled floor nozzle 2 and an upper assembly 4. The nozzle base 2 and the upper assembly 4 are preferably formed from conventional materials such as molded plastics and the like. As described further below, the upper assembly 4 is hingedly or pivotally secured to the floor nozzle 2 through opposing trunnions 7 (FIG. 8) extending from a motor housing 40 associated with the upper assembly 4.

The upper assembly 4 includes a lower handle portion 6, an upper handle portion 8 and a hand grip 10. The lower handle portion 6 is generally wishbone or U-shaped, and includes a pair of legs which define between them an opening 12. A motor/final filter assembly 14 is positioned within the opening 12, and is secured to the lower handle portion 6. A dirt cup assembly 18 is also positioned within the opening 12 above the motor/final filter assembly 14, and is removable from the upper assembly 4.

A cap 20 is pivotally mounted to the lower handle portion 6 above the dirt cup assembly 18. The cap 20 defines a portion of a latch assembly that cooperates with a catch frame (not shown) to secure the dirt cup assembly 18 to the upper assembly 4, as described and illustrated in the Assignee's copending U.S. patent application Ser. No. 09/758,725, the disclosure of which is hereby incorporated by reference. Further, the cap 20 includes at least one indentation on an upper surface thereof, which indentation is shaped to accommodate an associated cleaning tool of the vacuum cleaner.

The dirt cup assembly 18 includes i) a dirt cup 22, ii) a tubular or cylindrical primary filter assembly (not shown) removably positioned within the dirt cup 22, and iii) a lid 24 removably covering an open upper end of the dirt cup 22, as described and illustrated in the Assignee's copending U.S. patent application Ser. No. 09/758,834, the disclosure of which is hereby incorporated by reference. The primary filter assembly can be formed from any washable (e.g. reusable) or disposable filter medium such as a polytetrafluoroethylene (PTFE) material, a high-density polyethylene-based, opencelled, porous material, etc.

Briefly, the dirt cup 22 includes a central dust/debris collection or separation chamber 26, a forward dirty-air conduit or inlet duct 28, and a rear dirty-air conduit or inlet duct 30 circumferentially spaced from the forward inlet duct 28 by about 120°. A side wall defining the dirt cup 22 cooperates with the centrally-positioned primary filter assembly to define an annular, cyclonic airflow passage within separation chamber 26. A handle 32 extends from the dirt cup 22 at a position substantially opposite (i.e. about 180°) from the forward inlet duct 28.

The motor/final filter assembly 14 includes i) a motor housing 40 having a suction motor/fan assembly mounted approximately upright within the housing 40 such that a motor output shaft extends generally parallel to a central longitudinal axis of the upper assembly 4, ii) a final filter housing 42 positioned above and mounted to the motor housing 40, iii) a final or exhaust filter (e.g. HEPA) (not shown) removably positioned within the filter housing 42, and iv) a filter housing lid (not shown) removably covering the filter housing 42, as described and illustrated in the Assignee's copending U.S. patent application Ser. No. 09/759,437, the disclosure of which is hereby incorporated by reference.

Figure 3:
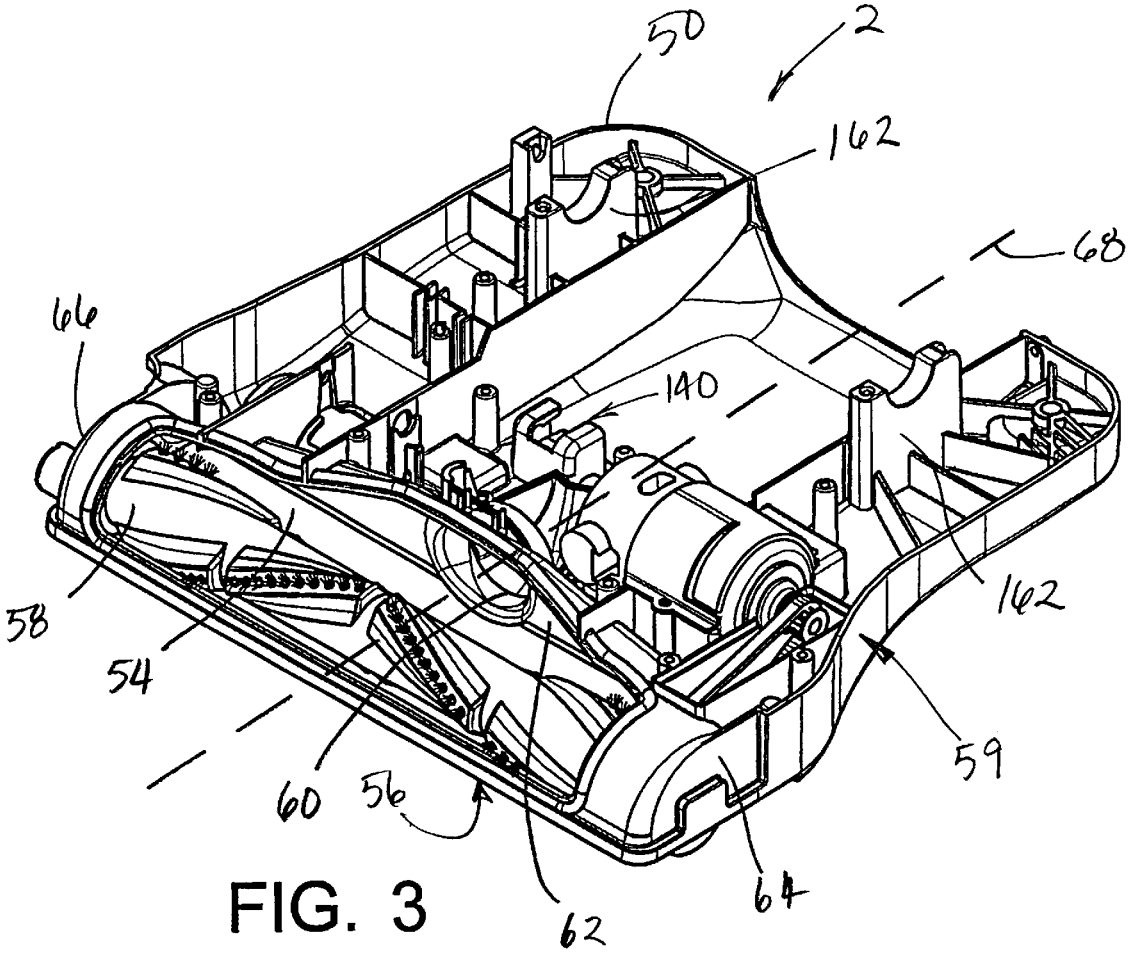
FIG. 3 is a perspective view from the right front of a floor nozzle base of the vacuum cleaner of FIG. 1.

With continued reference to FIGS. 1 and 2, and particular reference to FIG. 3, the floor nozzle 2 includes a base 50 and a cover 52. The floor nozzle further includes a brushroll chamber or cavity 54 that extends laterally along a front portion of the nozzle base and opens downwardly to form a nozzle inlet 56. The brushroll chamber 54 is adapted to receive and support a rotatable agitator or brushroll 58. The brushroll 58 is driven by a dedicated brushroll motor/drive belt assembly 59.

An aperture 60 extends through a rear wall 62 of the brushroll chamber 54. The aperture 60 is substantially centered between two side walls 64, 66 that define the lateral extent of brushroll chamber 54. Thus, the aperture 60 is substantially centered on a center line 68 of the floor nozzle 2. It should be appreciated that, with the aperture 60 substantially centered along the floor nozzle center line 68, a substantially even (i.e. symmetrical) amount of suction air flow can be drawn from each side of the nozzle inlet 56.

Figure 4:
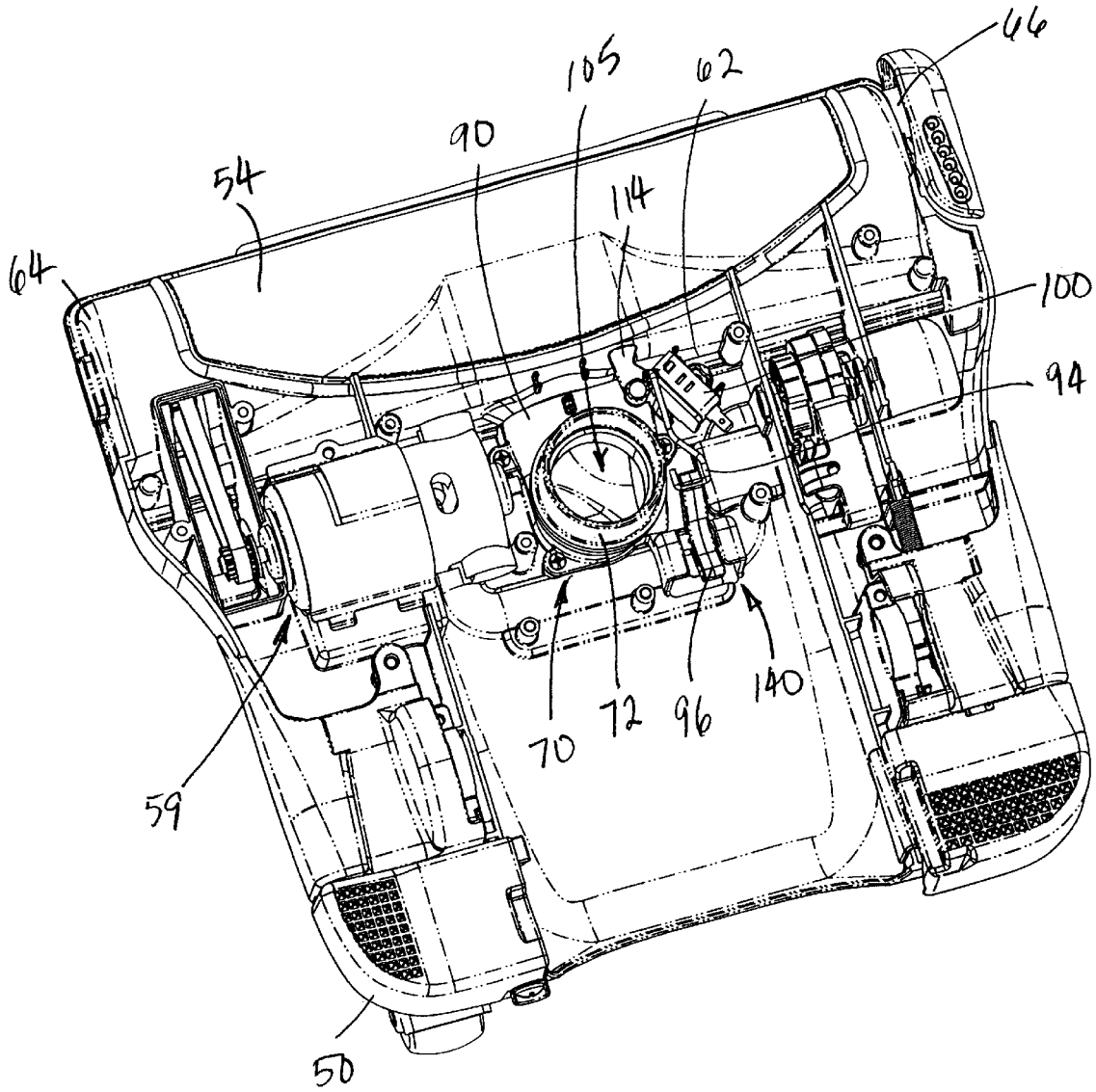
FIG. 4 is a perspective view from the right rear of the floor nozzle base of FIG. 3 showing a flow cut-off and brushroll shut-off mechanism (and a floor nozzle cover in phantom)

Referring now to FIG. 4, a flow cut-off mechanism 70 is positioned rearward of the brushroll chamber rear wall 62 and aperture 60. A discharge duct 72, such as a conventional flexible, expandable, helical wire-type hose, communicates with and extends from the flow cut-off mechanism 70 to an upper extent of a forward passageway 74 (FIG. 1) associated with the final filter housing 42. Thus, when the dirt cup assembly 18 is mounted to the vacuum cleaner, the forward inlet duct 28 is in fluid communication with the brushroll chamber 54 through the flexible hose 72 to establish a dirty airflow pathway for suction air that is drawn by a source of suction power (e.g. fan/motor assembly within motor housing 40) through the brushroll chamber 54 from the nozzle inlet 56.

Likewise, as shown in FIG. 2, when the dirt cup assembly 18 is mounted to the vacuum cleaner, the dirt cup rear inlet duct 30 is in fluid communication with an above-the-floor cleaning wand 76 through a connector 78 associated with the final filter housing 42 and a depending flexible hose 80 connected thereto.

A distal end of the wand 76 is retained in a storage cup 82 associated with the upper assembly 4. The storage cup 82 has a generally closed end (i.e. bottom) wall.

Thus, when the vacuum cleaner is energized and the wand 76 is positioned within the storage cup 82, the suction airflow through the hose 80 causes the wand 76 to be drawn against the storage cup end wall to, in effect, block or otherwise prevent a substantial suction airstream from flowing through the above-the-floor dirty airflow pathway during on-the-floor cleaning operations. Of course, the wand 76 can be removed from the storage cup 82 during operation of the vacuum cleaner against the suction force generated by the motor/fan assembly to perform above-the-floor cleaning operations.

It should be appreciated that, with the dirt cup assembly 18 mounted to the vacuum cleaner, the dirt cup inlet duct 28 is positioned forward of the lower handle portion 6, and the dirt cup inlet duct 30 is positioned rearward of the lower handle portion 6. This, in effect, minimizes the lengths of the dirty airflow pathways between the dust collection chamber 26 and the brushroll chamber 54, and between the dust collection chamber 26 and an above-the-floor cleaning tool secured to the wand 76, respectively.

Figure 5:
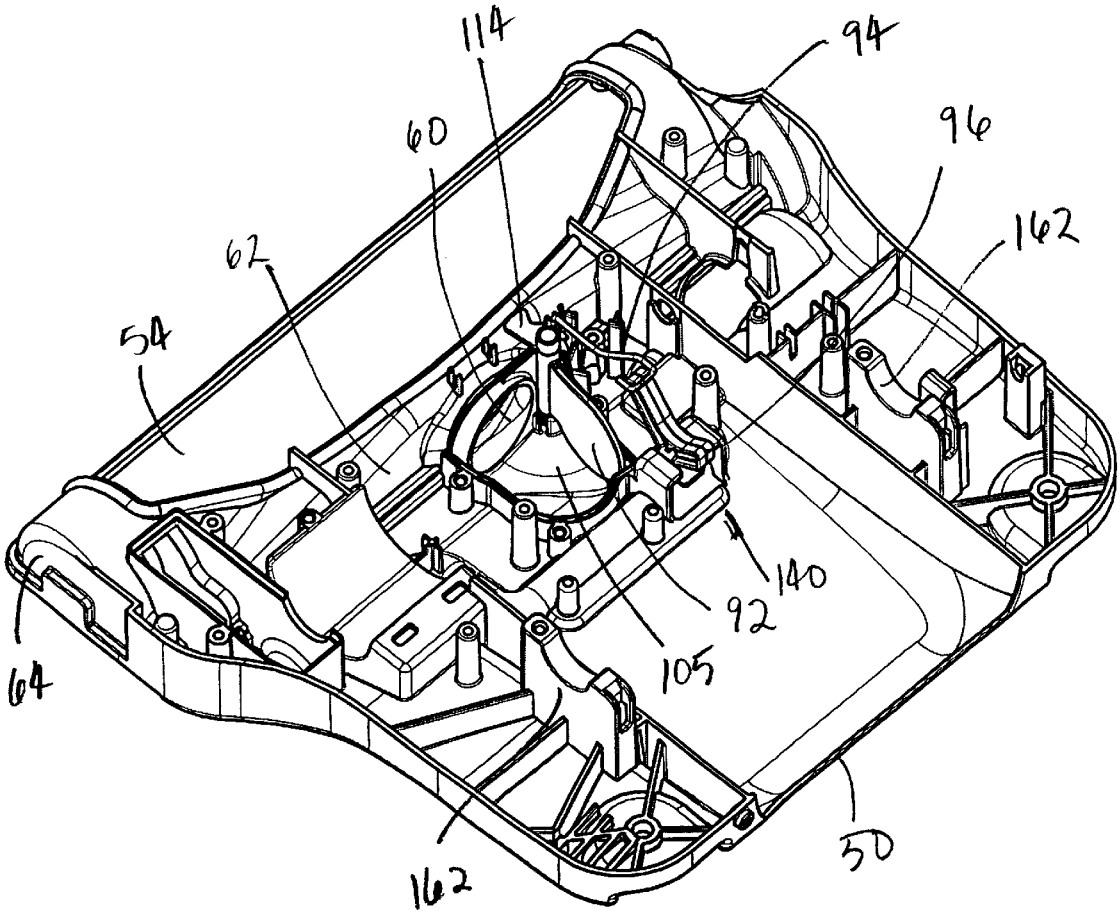
FIG. 5 is perspective view from the rear right of the floor nozzle base of FIG. 3 with a door passage cover of the flow cut-off mechanism removed.
Figure 6:
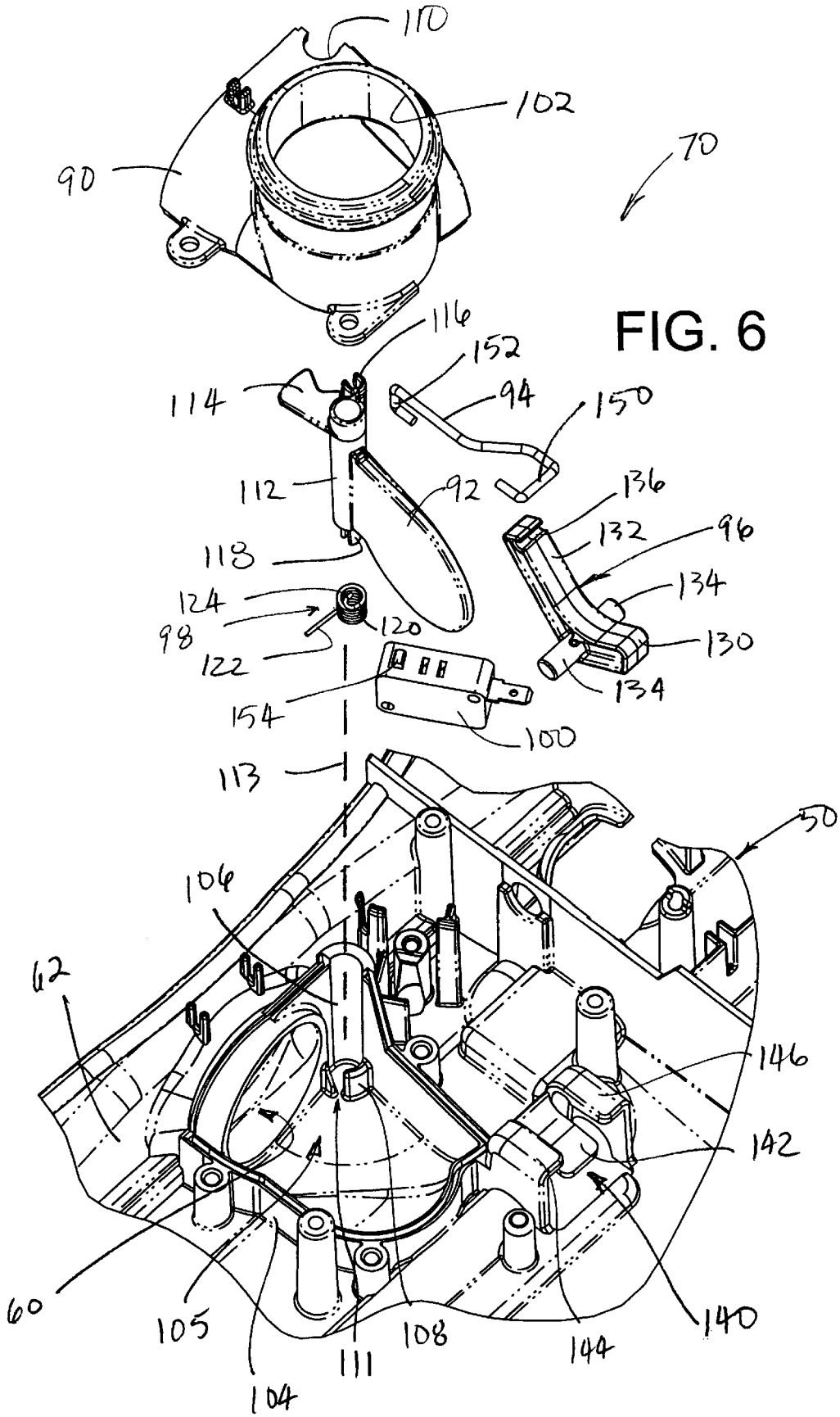
FIG. 6 is an enlarged exploded view, partially broken away, of the flow cut-off and brushroll shut-off mechanism of FIG. 4.

Referring now to FIGS. 5 and 6, the flow cut-off mechanism 70 includes a dirt passage cover 90, a dirt passage door 92, a link arm 94, a generally L-shaped lever arm 96, a coiled spring 98. A normally-on, micro-switch assembly 100 is used as the brushroll shut-off mechanism.

The dirt passage cover 90 includes an approximately upright opening 102 adapted to engage (e.g. threadably, frictionally, adhesively) with a forward end of the discharge hose 72. The dirt passage cover 90 is secured, such as by screws, etc., to a corresponding upright wall or rib 104 formed integral with the nozzle base 50. The dirt passage cover 90 and wall 104 cooperate to define a dirt passage 105. An elastomeric gasket or seal can be positioned between the cover 90 and the upright wall 104 to insure a fluid-tight seal therebetween. The brushroll chamber aperture 60 defines an inlet of the dirt passage 105, and the upright opening 102 of the cover 90 defines an outlet of the dirt passage 105.

The upright wall 104 includes an arcuate wall portion 106 that cooperates with an upstanding rib 108 projecting from the nozzle base 50 within the dirt passage 105, and with a recess 110 of the dirt passage cover 90 to pivotally support the dirt passage door 92 in an approximately upright orientation within the dirt passage 105. A notch 111 is formed in the upstanding rib 108.

The dirt passage door 92 extends from an upright pin 112, which pin pivots about an approximately vertical or upright axis 113. A control arm 114 extends from an upper extent of the pivot pin 112 in a direction generally opposite to that of the dirt passage door 92. A U-shaped notch or hook member 116 is formed integral with the pivot pin 112 proximate the control arm 114. A reduced diameter, notched portion 118 forms a lower extent of the upright pivot pin 112.

The coil spring 98 includes a intermediate coiled portion 120, a first arm 122 projecting radially outward from the coiled portion 120, and a second arm 124 projecting radially inward from the coiled portion 120. The spring coiled portion 120 surrounds the pivot pin reduced diameter portion 118 with the spring second arm 124 positioned within the notch of the pin reduced diameter portion 118 so that the spring second arm 124 moves (i.e. rotates) along with the pivot pin 112. The spring first arm 122 is positioned within the notch 111 of rib 108 to anchor or otherwise prevent movement of the spring first arm 122 relative to the pivot pin 112. As a result, the coil spring 98 biases the dirt passage door 92 in an open position within the dirt passage 105 as shown in FIG. 5.

The lever 96 includes a shorter arm 130 and a longer arm 132 extending at an obtuse angle (e.g. about 120°) from the shorter arm 130. A pair of trunnions 134 project in opposing directions from a juncture of the arms 130, 132. A free end of the longer arm 132 includes a notch or hook 136 therein. The lever 96 is pivotally secured to the nozzle base 50. More particularly, the lever 96 is pivotally supported by a clip arrangement 140 formed integral with the nozzle base 50. The clip arrangement 140 includes a cantilevered center clip 142 and opposing L-shaped flanges 144, 146 positioned on either side of the center clip 142. When the lever trunnions 134 are positioned under the L-shaped flanges 144, 146, the clip 142 urges the lever 96 and trunnions 134 upward into abutting contact with the flanges 144, 146.

The control link 94 includes a first hook-shaped end portion 150 that engages with the notch 136 associated with the longer lever arm 132. Likewise, a second hook-shaped end portion 152 of the control link 94 engages with the notch 116 associated with the upright pivot pin 112 of the dirt passage door 92.

The normally-on micro-switch assembly 100 electrically controls the operation of the brushroll motor 59. The switch assembly 100 includes a spring-biased contact element, plunger, button, or switch 154. The switch assembly 100 is positioned in a manner that permits the pivot pin control arm 114 to operatively engage the element 154 to shut-off the brushroll motor 59 and serves as the brushroll shut-off mechanism.

Figure 8:
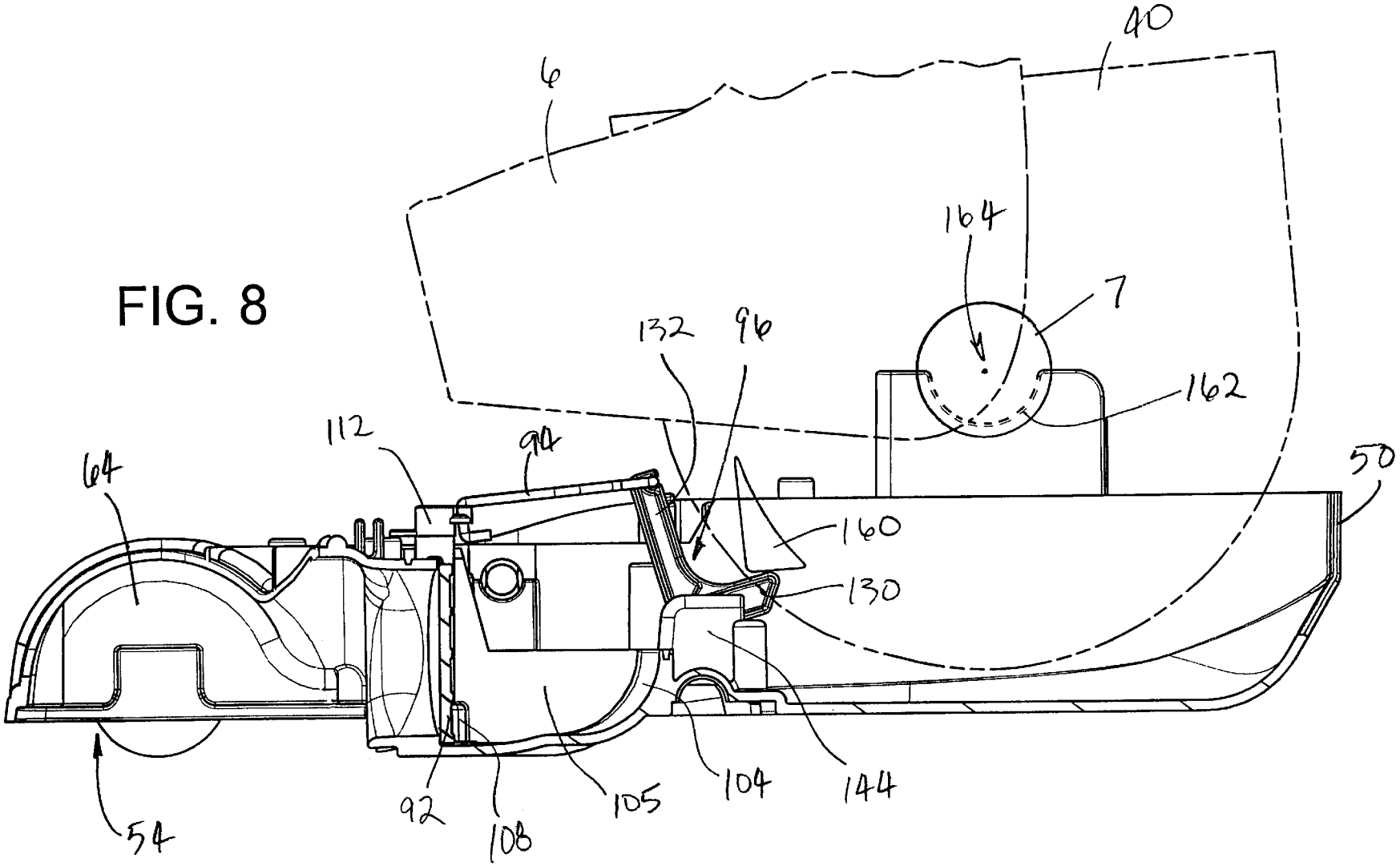
FIG. 8 is a cross-section view taken along the line 8—8 of the flow cut-off mechanism of FIG. 7.

As best shown in FIGS. 1 and 8, the upper assembly 4, and more particularly, the motor housing 40 includes a forwardly projecting nub 160 that is positioned to contact an upper surface of the shorter lever arm 130 when the upper assembly 4 is pivoted into a fully forward position relative to the floor nozzle 2. In addition, the nozzle base 50 includes upright bearing surfaces 162 that mutually conform to and rotatably support the upper assembly trunnions 7 so that the upper assembly 4 can pivot about a generally horizontal axis 164 relative to the floor nozzle 2.

During on-the-floor cleaning operations utilizing the nozzle base 2, the upper assembly 4 is pivoted rearward relative to the nozzle base 2. As a result, i) the motor housing nub 160 does not contact the shorter lever arm 130, ii) a spring force generated by the spring 98 urges the dirt passage door 92 to pivot rearward around the upright axis 113 into an open position with the dirt passage 105 as shown in FIG. 5, and iii) the control arm 114 does not engage the micro-switch element 154, thus the normally-on micro-switch 100 permits the brushroll motor 59 to operate.

Accordingly, dirty airflow is drawn by the motor/fan assembly within motor housing 40 along a substantially straight, and hence, short, path from the brushroll chamber 54 through aperture 60, dirt passage 105, opening 102, discharge duct 72, upper portion of passageway 74, dirt cup inlet duct 28, and into the cyclonic airflow passage within the dirt cup separation chamber 26.

It should also be appreciated that, by positioning the dirt cup inlet duct 28 along the vacuum cleaner center line 68 and forward of the lower handle portion 16, the length of the dirty airflow path from the brushroll chamber 54 to the dirt cup dust collection chamber 26 can be minimized, thus providing increased suction power in the brushroll chamber 54. In other words, the length of the dirty airflow pathway from the brushroll chamber 54 to the dirt cup dust collection chamber 26 can be minimized by completely positioning the dirty airflow pathway forward of the pivot axis 164 of the upper assembly 4. In addition, when the dirt passage door 92 is pivoted into the open position about upright axis 113, the door enables a free flow of suction air through the discharge duct 72, rather than block the duct 72 as would occur if the door was to pivot upward about a horizontal axis as in the prior art.

The dirty air flow drawn from the inlet duct 28 is diverted to a tangential path within the separation chamber 26 resulting in a cyclonic or vortex-type flow that spirals downward within the separation chamber 26. The cyclonic action separates a substantial portion of the entrained dust and dirt when the suction airstream is drawn radially inward through the primary filter assembly. The dust and dirt is deposited in the dirt cup 22. Thereafter, the suction airstream is drawn axially downward through a central suction duct of the final filter housing 42 and a motor/fan assembly within the motor housing 40, before being redirected back up through an annular exhaust flow passageway surrounding the motor/fan assembly and into an exhaust plenum of the final filter housing 42. Thereafter, the suction airstream is discharged radially outwardly through the final filter assembly, as described and illustrated more fully in the Assignee's copending U.S. patent application Ser. No. 09/759,437, the disclosure of which is again incorporated by reference.

Figure 7:
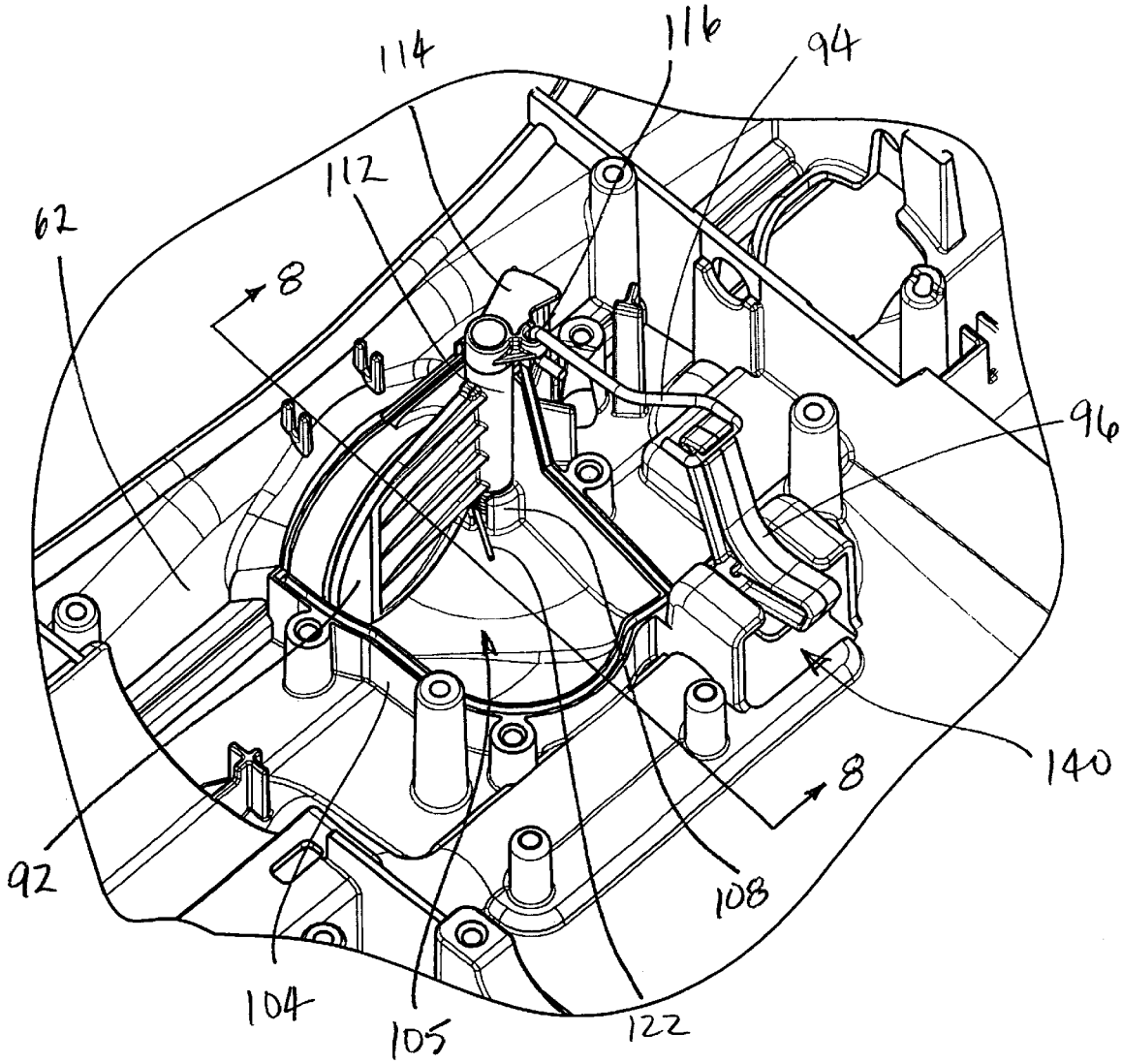
FIG. 7 is an enlarged perspective view, partially broken away, of the flow cut-off mechanism of FIG. 5 with a dirt passage door thereof partially closed.

Referring now to FIGS. 7 and 8, during above-the-floor cleaning operations utilizing the wand 76 and depending hose 80, the upper assembly 4 is pivoted fully forward relative to the nozzle base 2. As a result, i) the motor housing nub 160 contacts the shorter lever arm 130 and drives it downward, ii) the longer lever arm 132 and depending control link 94 are driven rearward, iii) the dirt passage door 92 is rotated forward about upright axis 113 into abutting contact with the aperture 60 against the biasing force of the spring 98, and iv) the pivot pin control arm 114 is rotated into operative engagement with the micro-switch element 154, thus shutting off the brushroll motor 59.

It should be appreciated that stopping or otherwise blocking the flow of suction air through the discharge duct 72 during above-the-floor cleaning operations results in diverting more suction air to the above-the-floor cleaning tool. Thus, dirty air flows from the cleaning tool/wand arrangement 76 and depending hose 80, through the dirt cup inlet duct 30, and into the dirt cup separation chamber 26. As mentioned above, positioning the dirt cup inlet duct 30 slightly rearward of the lower handle portion 6 minimizes the length of the dirty airflow path from an above-the-floor cleaning tool to the dirt cup separation chamber 26 to provide increased suction power at the cleaning tool. As with an on-the-floor cleaning operation, dirty air flow from the inlet duct 30 is diverted to a tangential path within the separation chamber to cause a cyclonic or vortex-type airflow that follows the same pathway through the dirt cup 22, filter housing 42, and motor housing 40 as described above.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described a preferred embodiment of invention, what is claimed is:

1. A floor nozzle for a vacuum cleaner, comprising:

a brushroll chamber having an outlet aperture; and a flow cut-off mechanism that selectively blocks the outlet aperture, the flow cut-off mechanism includes a dirt passage in communication with the outlet aperture and a dirt passage door that pivots about an approximately upright axis within the dirt passage cavity to block the outlet aperture;

a brushroll supported for rotation within the brushroll chamber, and a drive motor coupled to the brushroll; and, a brushroll shut-off mechanism comprising a switch coupled to the drive motor, the switch being actuatable by a control arm extending from an upright pivot pin on said door to control the drive motor.

2. The floor nozzle of claim 1, further comprising a lever wherein said control arm couples the lever to the dirt passage door, the lever being actuatable by an associated upper assembly of the vacuum cleaner resulting in the dirt passage door being pivoted into abutting contact with the outlet aperture.

3. The floor nozzle of claim 1, wherein the flow cut-off mechanism further includes a spring that biases the dirt passage door in an open position within the dirt passage.

4. The floor nozzle of claim 1, wherein the flow cut-off mechanism further includes a dirt passage cover associated with the dirt passage, the dirt passage cover having an outlet opening that communicates with a discharge duct leading to an associated dust/debris collection chamber of the vacuum cleaner.

5. The floor nozzle of claim 4, wherein the discharge duct is positioned fully forward of a pivot axis of an associated upper assembly of the vacuum cleaner.

6. The floor nozzle of claim 4, wherein the outlet aperture and the discharge duct are positioned on a center line of the floor nozzle.

7. The floor nozzle of claim 1, wherein the outlet aperture is positioned on a center line of the floor nozzle.

8. The floor nozzle of claim 1, wherein the dirt passage door further includes a notched portion proximate to the control arm that links the dirt passage door to a lever actuatable by an associated upper assembly of the vacuum cleaner.

9. A vacuum cleaner comprising:

a floor nozzle; and an upper assembly secured to the floor nozzle and adapted to pivot relative to the floor nozzle about a generally horizontal pivot axis;

the floor nozzle including a brushroll chamber having an outlet aperture, and a flow cut-off mechanism that selectively blocks the outlet aperture, the flow cut-off mechanism includes dirt passage in communication with the outlet aperture and a dirt passage door that pivots about an approximately upright axis within the dirt passage to block the outlet aperture;

a brushroll supported for rotation within the brushroll chamber, and a drive motor coupled to the brushroll, and a brushroll shut-off mechanism comprising a switch coupled to the drive motor, the switch being actuatable by control arm extending from the dirt passage door to control the drive motor.

10. The vacuum cleaner of claim 9, wherein the flow cut-off mechanism further includes a lever wherein said control arm couples the lever to the dirt passage door, the lever being actuatable by the upper assembly resulting in the dirt passage door being pivoted into abutting contact with the outlet aperture.

11. The vacuum cleaner of claim 9, wherein the flow cut-off mechanism further includes a spring that biases the dirt passage door in an open position within the dirt passage.

12. The vacuum cleaner of claim 9, wherein the upper assembly includes a dust/debris collection chamber, and the flow cut-off mechanism further includes a dirt passage cover associated with the dirt passage, the dirt passage cover having an outlet opening that communicates with a discharge duct leading to the dust/debris collection chamber.

13. The vacuum cleaner of claim 12, wherein the discharge duct is positioned fully forward of the generally horizontal pivot axis.

14. The vacuum cleaner of claim 12, wherein the outlet aperture and the discharge duct are positioned on a center line of the floor nozzle.

15. The vacuum cleaner of claim 9, wherein the dirt passage door further includes a notched portion proximate to the control arm that links the dirt passage door to a lever actuatable by the upper assembly.

16. A vacuum cleaner comprising:

a floor nozzle including a brushroll chamber having an outlet aperture;

an upper assembly secured to the floor nozzle and adapted to pivot relative to the floor nozzle about a generally horizontal pivot axis;

a dirt cup removably secured to the upper assembly, the dirt cup including a dirt collection chamber, a forward inlet duct, and a rear inlet duct spaced from the forward inlet duct; and a flow cut-off mechanism that selectively blocks the outlet aperture, the flow cut-off mechanism including a dirt passage in communication with the outlet aperture and a dirt passage door that pivots about an approximately upright axis within the dirt passage to block the outlet aperture when the upper assembly is moved to a fully upright position.

17. The vacuum cleaner of claim 16, wherein the floor nozzle further includes a brushroll supported for rotation within the brushroll chamber, and a drive motor coupled to the brushroll, and a brushroll shut-off mechanism comprising a switch coupled to the drive motor, the switch being actuatable by a control arm extending from the dirt passage door to control the drive motor.

18. The vacuum cleaner of claim 17, wherein the flow cut-off mechanism further includes a lever wherein said control arm couples the lever to the dirt passage door, the lever being actuatable by an associated upper assembly of the vacuum cleaner resulting in the dirt passage door being pivoted into abutting contact with the outlet aperture.

19. The vacuum cleaner of claim 16, wherein the flow cut-off mechanism further includes a dirt passage cover associated with the dirt passage, the dirt passage cover having an outlet opening that communicates with a discharge duct leading to a dirt cup forward inlet duct.

20. The vacuum cleaner of claim 19, wherein the outlet aperture, the discharge duct, and the dirt cup forward inlet duct are positioned along a center line of the vacuum cleaner.

21. The vacuum cleaner of claim 19, wherein the outlet aperture, the discharge duct, and the dirt cup forward inlet duct are positioned fully forward of the generally horizontal pivot axis when the upper assembly is moved to the fully upright position.

* * * * *